US008535166B1

(12) United States Patent
Weed et al.

(10) Patent No.: US 8,535,166 B1
(45) Date of Patent: Sep. 17, 2013

(54) STYLIZED SUPPORT AND ACCESSORY HOLDER FOR A VIDEO GAME CONSOLE

(76) Inventors: Matthew A. Weed, Horseheads, NY (US); Thomas D. Weed, Jr., Horseheads, NY (US)

( * ) Notice: Subject to any disclaimer, the term of this patent is extended or adjusted under 35 U.S.C. 154(b) by 43 days.

(21) Appl. No.: 12/783,665

(22) Filed: May 20, 2010

(51) Int. Cl.
*A63F 9/24* (2006.01)

(52) U.S. Cl.
USPC ..... 463/46; 463/47

(58) Field of Classification Search
USPC ..... 463/46
See application file for complete search history.

(56) References Cited

U.S. PATENT DOCUMENTS

| | | | | |
|---|---|---|---|---|
| 4,394,055 | A | 7/1983 | Smith | |
| D273,165 | S | 3/1984 | Sternberg | |
| 4,630,823 | A | 12/1986 | Grant | |
| 5,213,327 | A * | 5/1993 | Kitaue | 463/38 |
| 6,213,866 | B1 * | 4/2001 | Impellizzeri | 454/184 |
| 6,309,016 | B1 * | 10/2001 | Aloisi | 297/181 |
| D457,193 | S | 5/2002 | Brulotte et al. | |
| D556,836 | S | 12/2007 | Ashida et al. | |
| 7,316,618 | B2 * | 1/2008 | Hsu | 463/37 |
| D568,317 | S | 5/2008 | Lewis | |
| 2009/0156061 | A1 * | 6/2009 | Bernstein | 439/652 |
| 2011/0092294 | A1 * | 4/2011 | Mercier | 463/46 |

OTHER PUBLICATIONS

Randolph Ramsey; Sony Playstation 3, Mar. 22, 2007, http://www.cnet.com.au/sony-playstation-3-240054851.htm#image1 pp. 1-10.*
Sony Playstation 3 Manual (2007) http://www.videogameconsolelibrary.com/images/Manuals/PS3-CECHE01_(80GB)-Manual.pdf pp. 1-41.*
Playstation Universe, May 24, 2006, http://www.psu.com/forums/showthread.php/19171-3-LED-s-on-the-front-of-the-PS3 pp. 1-3.*
Sony Playstation Forum, Jun. 10, 2009, http://community.us.playstation.com/t5/PlayStation-3/How-to-Keep-Your-PS3-Quiet-Healthy-Cool-and-Long-Living/td-p/5165632 pp. 1-2.*

* cited by examiner

*Primary Examiner* — Tramar Harper
(74) *Attorney, Agent, or Firm* — Mark Levy; Hinman, Howard & Kattell, LLP

(57) ABSTRACT

A stylized support and accessory holder for an electronic game console, having an overall shape of an insect or other animal. The support base raises an electronic game console above the floor to minimize intake of dust and other debris often circulating near the floor of a room. In addition, the base may include one or more fans to improve air circulation within the game console. Recharge stations are provided for controllers. An internal circuit breaker is used to protect multiple accessory outlets on the body of the support base. The support base is designed to be decorative and whimsical, but practical. The base supplies electrical power, cooling air, and recharging power for controllers or accessories, as well as electrical power for accessories. All supplied power is protected by a built-in circuit breaker.

20 Claims, 8 Drawing Sheets

STYLIZED SUPPORT AND ACCESSORY HOLDER FOR A VIDEO GAME CONSOLE

BACKGROUND OF THE INVENTION

1. Field of the Invention

The invention pertains to support stands and accessory holders and, more particularly, to a stylized support for a video game console shaped like a spider, cricket, snake, etc.

Video game consoles are ubiquitous, many households owning more than one. Such video game consoles are often placed directly on the floor of a room where they are subject to dust and similar contamination. When sucked into an interior region of the game console, dust seriously affects the life and reliability of the console. Also, such placement may seriously affect the flow of cooling air through the console causing elevated operating temperatures.

Modern, highly sophisticated video game systems rely on numerous different remote devices for their operation. Each type of video game may require a unique hand-held controller. These controllers often communicate with the game console wirelessly. Consequently, each controller generally contains one or more batteries. Such controllers may be equipped with rechargeable batteries and should periodically be plugged into a source of AC power to effect battery recharge. With a multiplicity of remote units, the tangle of wires, cables, power strips, etc. required to keep controllers charged often creates an unsightly mess as well as possible electrical hazards.

Further, sophisticated electronic or video gaming systems usually attract or require accessories, operating manuals, etc. that are advantageously kept near the game console.

2. Discussion of the Related Art

Several attempts to solve one or more of the aforementioned problems may be found in the prior art. For example, U.S. Pat. No. 4,394,055 for CABINET FOR VIDEO GAME CONSOLES, CARTRIDGES, ACCESSORIES, AND INSTRUCTION BOOKLETS, issued Jul. 19, 1983 to Richard D. Smith describes a storage case having storage compartments specifically sized and configured to receive and retain a game console as well as typical accessories and components used therewith.

U.S. Design Pat. No. D273,165 for ELECTRONIC GAME STAND, issued Mar. 27, 1984 to Steven Sternberg discloses a stand for a video game console and several accessories.

U.S. Pat. No. 4,630,823 for VIDEO GAME CONTROL BOX HOLDER issued Dec. 23, 1986 to Timothy L. Grant shows an adjustable appendage for supporting a game controller.

U.S. Design Pat. No. D457,193 for VIDEO GAME CONSOLE STAND, issued May 14, 2002 to Marc Brulotte et al. discloses a stylized support stand for a video game console.

U.S. Design Pat. No. D556,836 for ELECTRONIC GAME MACHINE SUPPORTED ON A BASE STAND, issued Dec. 4, 2007 to Kenichiro Ashida et al. shows another support base for an electronic game console.

U.S. Design Pat. No. D568,317 for BASE FOR A TOY, issued May 6, 2008 to Kate Lewis teaches a stylized, curvilinear support base for an object such as an electronic game console.

None of the patents and published patent applications, taken singly or in any combination, are seen to teach or suggest the novel stylized support and accessory holder for a video game console of the present invention.

SUMMARY OF THE INVENTION

In accordance with the present invention there is provided a stylized support and accessory holder for an electronic (e.g., video) game console, typically having an overall shape of an insect or other domestic or extraterrestrial animal. The support base raises an electronic game console above the floor to minimize intake of dust and other debris often circulating near the floor of a room. In addition, the base may include one or more fans to improve air circulation within the game console. Recharge stations are provided for controllers. An internal circuit breaker is used to protect multiple accessory outlets on the body of the support base. The support base is designed to be decorative and whimsical, but practical. The design overcomes all of the aforementioned problems often associated with electronic game consoles. In effect, the support base of the invention provides more than physical support to the gaming console supported thereby. Rather, the support base forms a "life support system." The base supplies electrical power and cooling air and recharging power for controllers or accessories, as well as electrical power for accessories. All supplied power is protected by a built-in circuit breaker. Physical storage for controllers or other accessories is also provided.

It is, therefore, an object of the invention to provide a stylized support and accessory holder for a video game console that supports an electronic game console above the floor away from dust and debris.

It is another object of the invention to provide a stylized support and accessory holder for a video game console that provides fan-driven cooling air.

It is an additional object of the invention to provide a stylized support and accessory holder for a video game console that provides storage for controllers or other accessories.

It is a further object of the invention to provide a stylized support and accessory holder for a video game console that provides recharge power for controllers and/or accessories.

It is a still further object of the invention to provide a stylized support and accessory holder for a video game console that provides circuit breaker protected line power to accessories via a plurality of built-in electrical outlets.

It is yet another object of the invention to provide a stylized support and accessory holder for a video game console that is constructed to resemble an insect such as a spider or cricket or another insect or animal.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
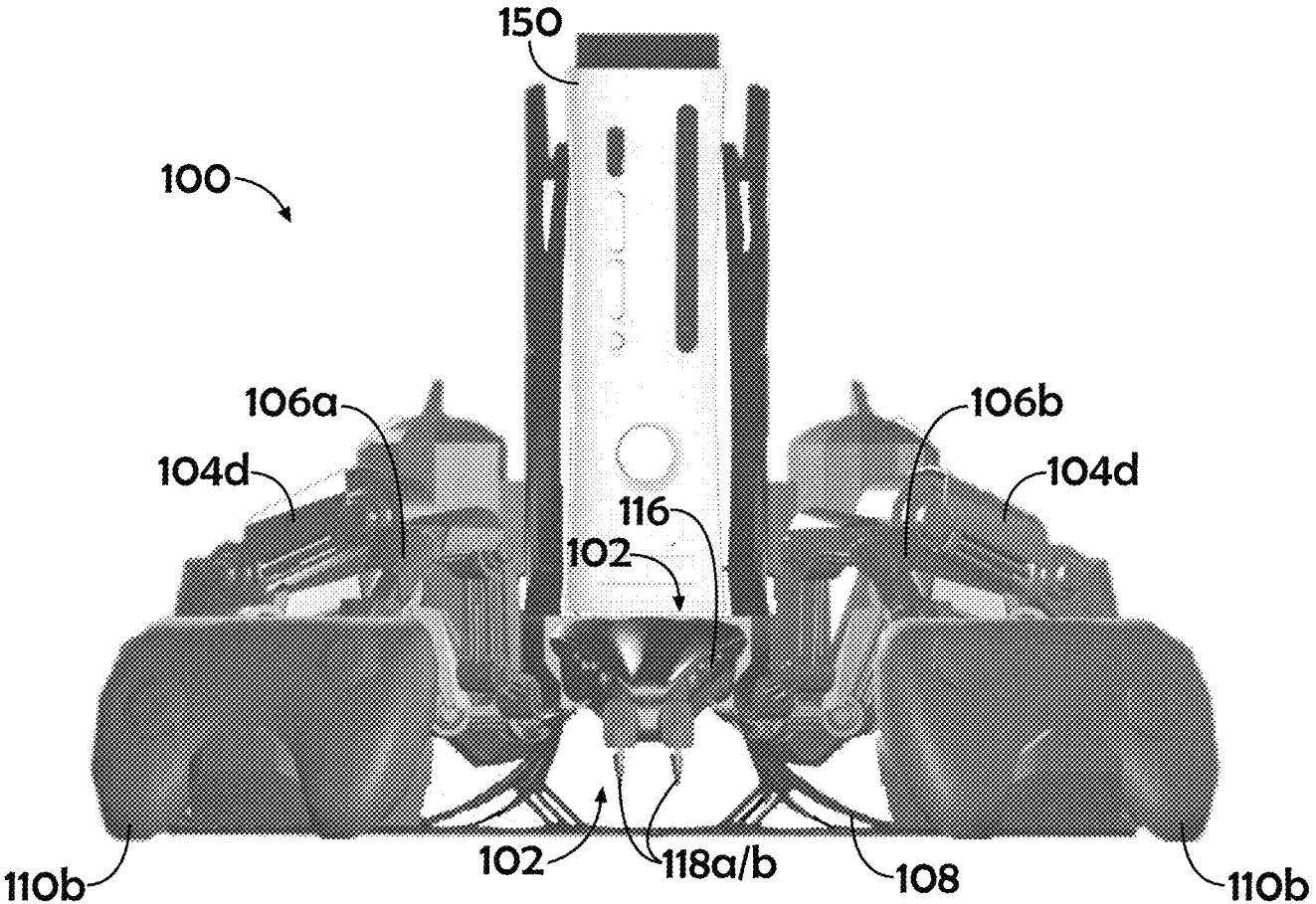
FIG. 1 is a front, elevational, pictorial, schematic view of a first embodiment of the stylized support base in accordance with the invention.

The present invention provides a stylized support stand and accessory holder for an electronic (e.g., video) game console, typically having an overall shape of an insect or other animal. The support base raises a gaming console above the floor to minimize intake of dust and other debris while providing one or more fans to improve air circulation within the game console. Recharge stations are provided for controllers. An internal circuit breaker is used to protect multiple accessory outlets on the body of the support base. The support base is designed to be decorative and whimsical, but practical. The base supplies electrical power and cooling air, and recharging power for controllers or accessories, as well as electrical power for accessories. All supplied power is protected by a built-in circuit breaker. Physical storage for controllers or other accessories is also provided.

Referring first to FIGS. 1-5, there are shown front, left side, and rear elevational, and top and bottom plan, pictorial schematic views, respectively, of a first embodiment of a stylized support stand in accordance with the present invention, generally at reference number 100.

Stylized support stand 100 has a central base 102 adapted to receive and support a bottom surface, not shown, of an electronic game console 150. Electronic game console 150 forms no part of the present invention and is included merely to better illustrate the intended use and environment of stylized support stand 100. As used herein, the term electronic game or gaming console is intended to represent any similar piece of electrical equipment that may be advantageously supported on stylized support stand 100.

Base 102 is supported on and elevated above a horizontal support surface such as a floor by six support legs 104*a*, . . . , 104*f*, legs 104*a*, . . . , 104*c* being disposed on a left side of base 102, and legs 104*d*, . . . , 104*f* being disposed on a right side of base 102. In the embodiment chosen for purposes of disclosure, support legs 104*a*, . . . , 104*f* are articulated and stylized to resemble the legs of a spider. Webs 108 are attached between legs 104*a*, . . . , 104*c* and between legs 104*d*, . . . , 104*f* on respective right and left sides of stylized support base 100. Of course in other embodiments, more or fewer legs may be used, eight being realistic for arachnids, for example, six being realistic for insects.

Two additional leg-like structures 106*a*, 106*b* project from a front edge of base 102 and act as controller chargers or may, optionally, perform other holding or storage functions. In the embodiment chosen for purposes of disclosure, controllers 110*a*, 110*b* are shown at the distal ends of leg-like structures 106*a*, 106*b*, respectively. Controllers 110*a*, 110*b* form no part of the present invention and are illustrated merely to better show the function and/or intended operating environment of stylized support base 100.

A head-like structure 112 is also attached to a front edge of base 102. Eyes 114 are disposed on the right and left side of head-like structure 112. Eyes 114 are typically implemented using LEDs 116 and serve merely decorative purposes. However, in alternate embodiments, LEDs 116 could be used to indicate a predetermined condition or status.

Fangs 118*a*, 118*b* at the proximal end of head-like structure 112 are switches. In the embodiment chosen for purposes of disclosure, switches 118*a*, 118*b* serve as power and fan switches, respectively. It will be recognized, however, that the assignment of power and fan switching may be reversed. In still other embodiments, other functions may be assigned to switches 118*a*, 118*b*. Also, fewer or more switches may readily be implemented. Consequently, the invention is not considered limited to a particular function assigned to one or both of switches 118*a*, 118*b* or to the number switches implemented.

Figure 2:
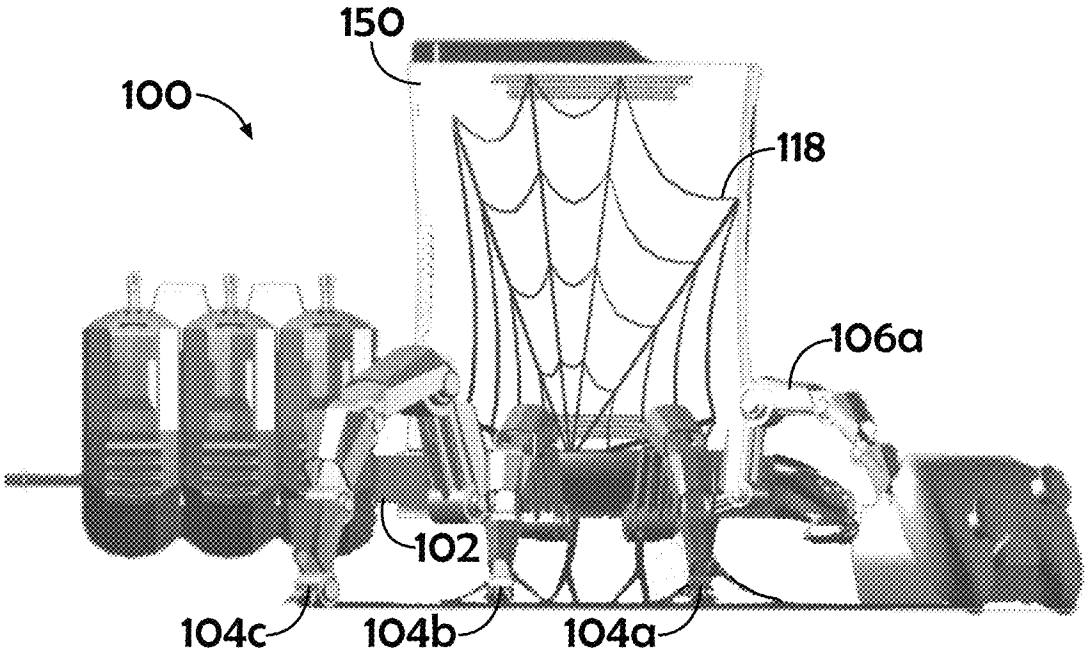
FIG. 2 is a left, elevational, pictorial, schematic view of the support base of FIG. 1.
Figure 3:
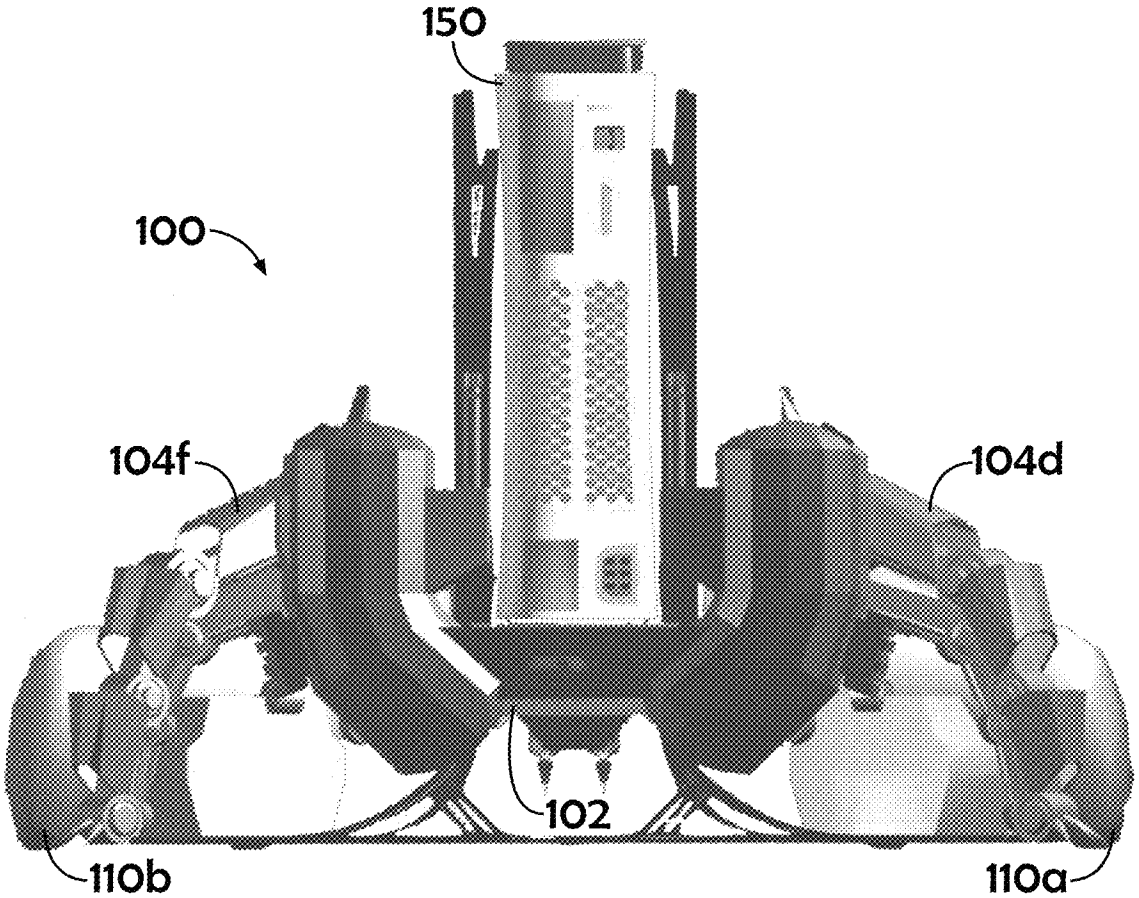
FIG. 3 is a rear, elevational, pictorial, schematic view of the support base of FIG. 1.
Figure 4:
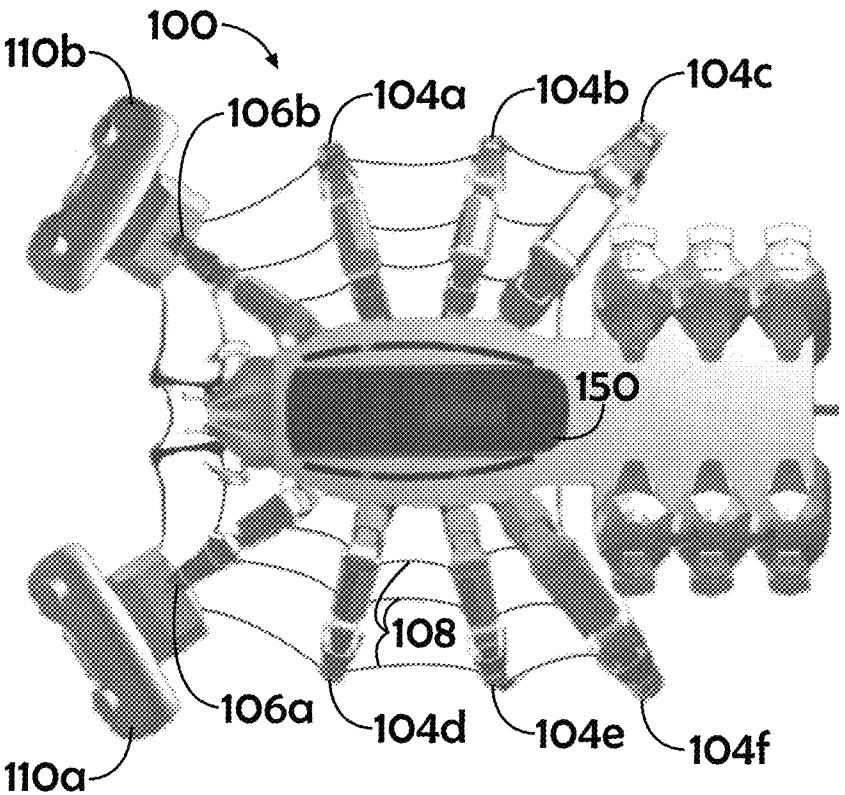
FIG. 4 is a top, plan, pictorial, schematic view of the support base of FIG. 1.
Figure 5:
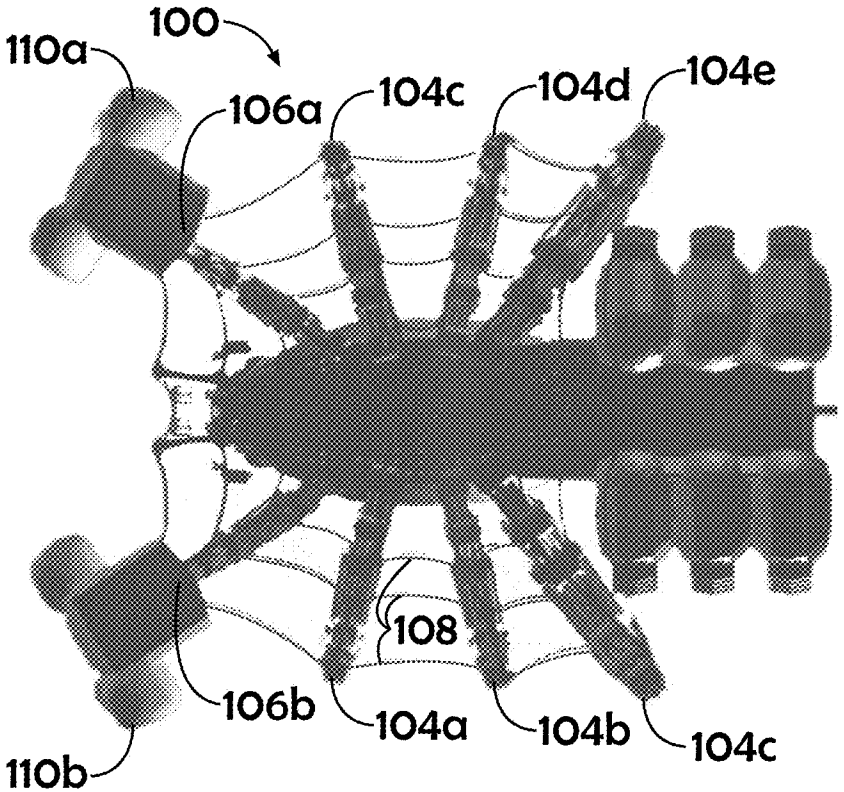
FIG. 5 is a bottom, plan, pictorial, schematic view of the support base of FIG. 1.

A web-like structure 120, best seen in FIG. 2, forms a side wall to steady and secure electronic game console 150.

Figure 6:
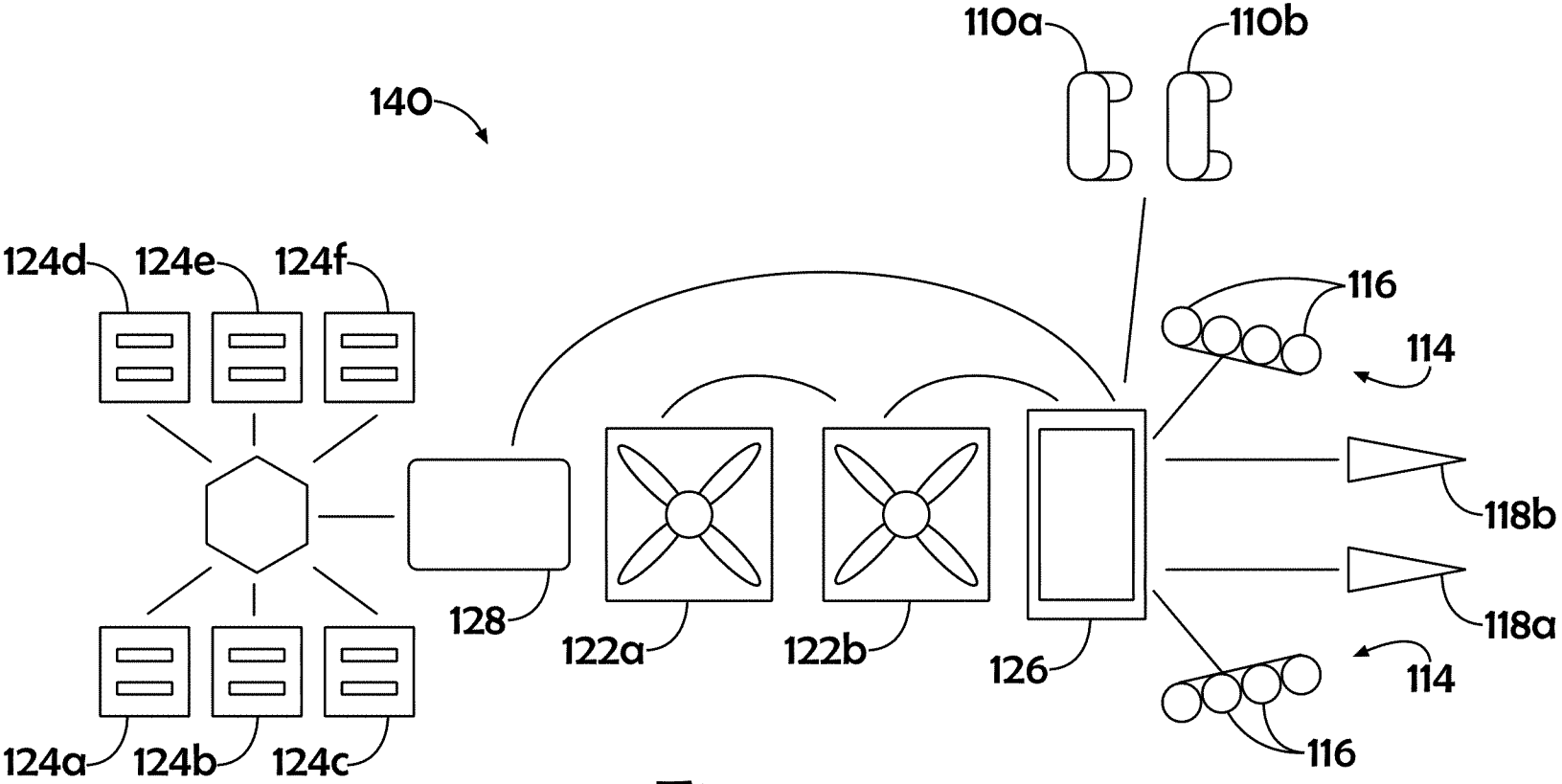
FIG. 6 is a simplified electrical block diagram of the support base of FIG. 1.

Referring now also to FIG. 6, there is shown a simplified electric block diagram of stylized support base 100, generally at reference number 140.

A circuit board 126 is utilized to interconnect all electrical components and sub-systems of stylized support base 100. Fang switches 118*a*, 118*b*, LEDs 116 forming eyes 114, controller chargers for controllers 110*a*, 110*b*, and fans 112*a*, 112*b* are all operatively connected to circuit board 126. Likewise, outlets 124*a*, . . . , 124*d* are connected to circuit board 126, typically on a pluggable adapter 128 adapted for removable attachment to base 102 of stylized support base 100.

Figure 7A:
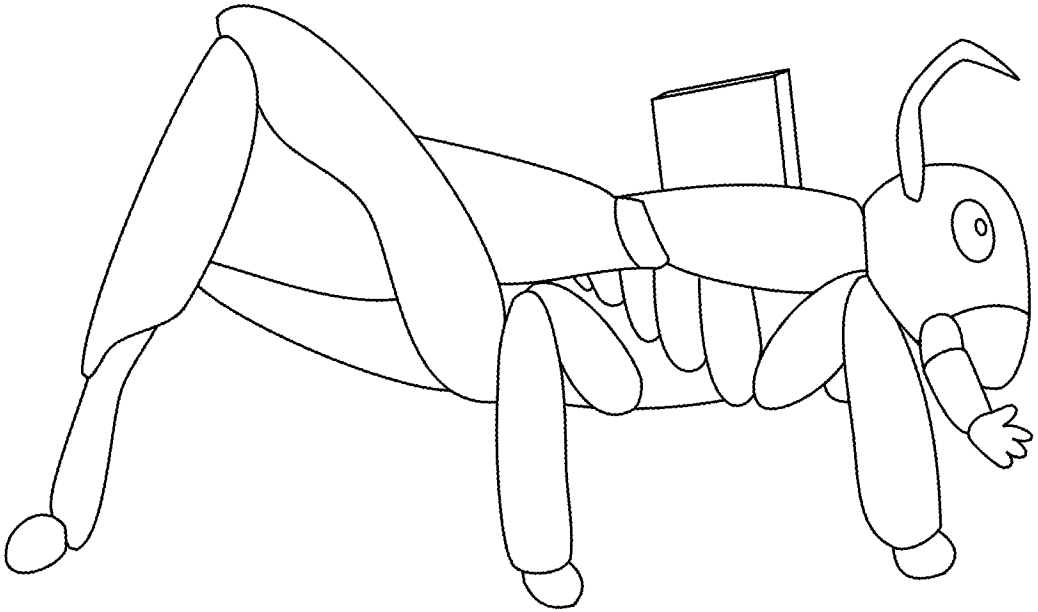
FIG. 7*a* is a side, elevational schematic view of a first alternate embodiment of the support base of FIG. 1.
Figure 7B:
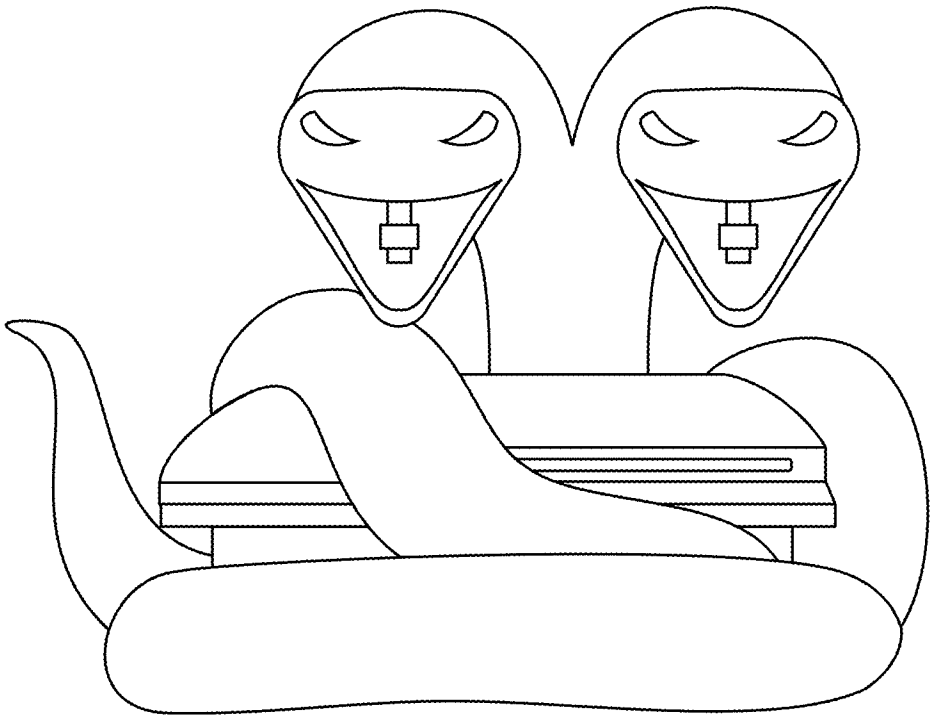
FIG. 7*b* is a front, elevational, schematic view of a second alternate embodiment of the support base of FIG. 1.

While a spider has been chosen as an overall shape for stylized support base 100, it will be recognized that many other possibilities exist. For example, FIG. 7*a* depicts a cricket-like shape while FIG. 7*b* depicts a snake-like configuration. Further, the design and functional elements of stylized support base 100 may be extended to a multitude of other shapes. A few examples include: a piece of furniture, a vehicle, a plant, an appliance, a historic structure, a cultural or religious icon, etc. Consequently, the invention is not considered limited to any particular overall appearance. Rather, the invention is intended to encompass any overall appearance.

It will further be recognized that additional features may be added to stylized support base 100.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A support base for an electronic game console, comprising a body comprising:

a) a base portion having a forward edge and a rearward edge and an outer boundary and configured to receive and support an electronic game console above a horizontal environmental surface;

b) at least four articulated legs resting on said horizontal environmental surface and supporting said base portion and at least two legs comprising support structures for receiving, retaining, and electrically recharging an accessory associated with an electronic game console supported on said base portion, said articulated legs also extending beyond said outer boundary of said base portion;

c) a head portion chosen from the group: a spider, a cricket, a snake, another insect or animal, a piece of furniture, a vehicle, a plant, an appliance, a historic structure, and a cultural or religious icon, attached to and extending outwardly from said forward edge of said base portion;

d) a rear portion attached to and extending outwardly from said rearward edge of said base portion;

e) at least one electrical switch attached to said body; and f) at least one electrical outlet attached to said body.

2. The support base for an electronic game console as recited in claim 1, wherein said body comprises a figure of a creature.

3. The support base for an electronic game console as recited in claim 1, wherein said rear portion comprises an adapter unit removably attached to said base portion.

4. The support base for an electronic game console as recited in claim 3, wherein said adapter unit comprises at least one electrical outlet.

5. The support base for an electronic game console as recited in claim 1, wherein said head further comprises at least one selected from the group: a visual indicator, and at least one switch.

6. The support base for an electronic game console as recited in claim 5, wherein said visual indicator comprises a plurality of light sources disposed to resemble at least one eye.

7. The support base for an electronic game console as recited in claim 6, wherein said plurality of light sources comprises at least one LED.

8. The support base for an electronic game console as recited in claim 5, wherein said at least one switch resembles a fang.

9. The support base for an electronic game console as recited in claim 5, wherein a first one of said at least one switch comprises a power switch and a second one of said at least one switch comprises a fan switch.

10. The support base for an electronic game console as recited in claim 1, further comprising:

g) a structure comprising a plurality of filaments disposed between at least two of said plurality of articulated legs.

11. The support base for an electronic game console as recited in claim 1, further comprising:

g) at least one fan attached to said body to provide cooling air to an electronic game console supported on said base portion.

12. The support base for an electronic game console as recited in claim 1, further comprising:

g) a side support extending upwardly from an upper surface of said base portion to enclose a body of an electronic game console supported on said base portion.

13. The support base for an electronic game console as recited in claim 12, wherein said side support resembles a spider web.

14. A support base for an electronic game console, having a spider-like form and comprising a body comprising:

a) a base portion configured to receive and support an electronic game console above a horizontal environmental surface;

b) at least six articulated, stylized legs attached to said base portion and extending generally downward and outward therefrom;

c) a pair of stylized, articulated appendages attached to said base portion and disposed forward of said at least six articulated, stylized legs, each of said pair of articulated appendages having a distal end configured to receive, retain, and recharge a game controller disposed thereat;

d) a head portion attached to and extending outwardly from a forward edge of said base, said head portion having a pair of structures representing eyes and comprising LEDs and a pair of fangs disposed at a forward tip thereof, said fangs comprising electrical switches;

e) an adapter unit removably attached to said base and extending rearwardly from a rear edge thereof, said adapter unit comprising a plurality of electrical outlets;

f) at least one fan disposed within said body and configured to direct cooling air to an electronic game console supported on said base portion;

g) a side support resembling a spider web extending upwardly from an upper surface of said base portion; and h) web-like filaments disposed between at least one selected from the group: at least two of said articulated, stylized legs, and at least one of said articulated, stylized legs and one of said pair of stylized, articulated, leg-like appendages.

15. A support base for an electronic game console, comprising a body comprising:

a) a base portion having a forward edge and a rearward edge and an outer boundary and configured to receive and support an electronic game console above a horizontal environmental surface;

b) a plurality of articulated legs attached to said base portion and extending generally downward therefrom, said plurality of articulated legs for receiving, retaining, and electrically recharging an accessory comprising a game controller associated with an electronic game console supported on said base portion also extending beyond said outer boundary of said base portion;

c) a head portion chosen from the group: a spider, a cricket, a snake, another insect or animal, a piece of furniture, a vehicle, a plant, an appliance, a historic structure, and a cultural or religious icon, attached to and extending outwardly from said forward edge of said base portion;

d) a rear portion attached to and extending outwardly from said rearward edge of said base portion;

e) at least one electrical switch attached to said body; and f) at least one electrical outlet attached to said body.

16. The support base for an electronic game console as recited in claim 15, wherein said body comprises a figure of a creature.

17. The support base for an electronic game console as recited in claim 15, wherein said rear portion comprises an adapter unit removably attached to said base portion.

18. The support base for an electronic game console as recited in claim 17, wherein said adapter unit comprises at least one electrical outlet.

19. The support base for an electronic game console as recited in claim 15, wherein said head further comprises at least one selected from the group: a visual indicator, and at least one switch.

20. The support base for an electronic game console as recited in claim 15, further comprising:

g) at least one fan attached to said body to provide cooling air to an electronic game console supported on said base portion.

* * * * *